US010208454B2

(12) United States Patent
Barr

(10) Patent No.: US 10,208,454 B2
(45) Date of Patent: Feb. 19, 2019

(54) APPARATUS FOR THE REMOVAL OF SLUDGE

(71) Applicant: Barrnon Ltd, Apple-in-Westmorland (GB)

(72) Inventor: Andrew Fraser Barr, Appleby (GB)

(73) Assignee: BARRNON LTD., Appleby-in-Westmorland, Cumbria (GB)

( * ) Notice: Subject to any disclaimer, the term of this patent is extended or adjusted under 35 U.S.C. 154(b) by 35 days.

(21) Appl. No.: 15/310,673

(22) PCT Filed: Nov. 17, 2014

(86) PCT No.: PCT/GB2014/053392

§ 371 (c)(1),
(2) Date: Nov. 11, 2016

(87) PCT Pub. No.: WO2015/173531

PCT Pub. Date: Nov. 19, 2015

(65) Prior Publication Data

US 2017/0073928 A1 Mar. 16, 2017

(30) Foreign Application Priority Data

May 12, 2014 (GB) ..... 1408295.2

(51) Int. Cl.
*E02F 5/28* (2006.01)
*B08B 9/093* (2006.01)

(52) U.S. Cl.
CPC ..... *E02F 5/285* (2013.01); *B08B 9/0933* (2013.01); *B08B 9/0936* (2013.01); *E02F 5/28* (2013.01); *E02F 5/287* (2013.01)

(58) Field of Classification Search
CPC ... E02F 5/28; E02F 5/282; E02F 5/285; E02F 5/287
(Continued)

(56) References Cited

U.S. PATENT DOCUMENTS 281,905 A * 7/1883 Meinesz ..... E02F 5/287 37/342
1,583,132 A * 5/1926 Falley ..... E02B 3/02 37/316
(Continued)

FOREIGN PATENT DOCUMENTS

JP S561812 Y2 1/1981
JP S6055134 A 3/1985
(Continued)

*Primary Examiner* — Tara Mayo-Pinnock
(74) *Attorney, Agent, or Firm* — Alan G. Towner; Leech Tishman Fuscaldo & Lampl

(57) ABSTRACT

Apparatus for removing sludge from an underwater deposit comprises a blade having a cutting edge that points forwards and a blade surface to the rear of the cutting edge that faces the interior of a housing. Nozzles are positioned and oriented to direct jets of water onto the blade surface to fluidize sludge that has been cut by the blade. The jets have a component of motion in the rearward direction relative to the blade surface, whereby the fluidized sludge is effectively contained within the housing and high collection rates can be achieved. The apparatus can be adapted for horizontal use over the surface of a sludge deposit or for movement in any direction through a bulk sludge deposit.

31 Claims, 4 Drawing Sheets

(58) Field of Classification Search
USPC ..... 37/342–344
See application file for complete search history.

(56) References Cited

U.S. PATENT DOCUMENTS

| | | | | |
|---|---|---|---|---|
| 3,588,174 | A | 6/1971 | Rossfelder et al. | |
| 13,802,740 | | 4/1974 | Sullivan | |
| 4,070,061 | A | 1/1978 | Obolensky | |
| 4,141,159 | A | 2/1979 | Morris et al. | |
| 4,407,035 | A | 10/1983 | Lindqvist | |
| 5,481,815 | A * | 1/1996 | Murphy | B09C 1/00 239/163 |
| 5,546,682 | A * | 8/1996 | Skerry | E02F 3/9206 37/322 |
| 6,848,860 | B2 * | 2/2005 | Peyton | B65G 5/00 37/342 |
| 2010/0299972 | A1 * | 12/2010 | Tack | 37/318 |

FOREIGN PATENT DOCUMENTS

| | | | |
|---|---|---|---|
| JP | H05214741 | A | 8/1993 |
| JP | H08243519 | A | 9/1996 |
| JP | 200210631 | A | 8/2000 |
| JP | 2001029909 | A | 2/2001 |
| JP | 2001279707 | A | 10/2001 |
| JP | 2003500572 | A | 1/2003 |
| JP | 2004308294 | A | 11/2004 |
| JP | 2011194288 | A | 10/2011 |
| RU | 2050993 | C1 | 12/1995 |
| RU | 2301296 | C1 | 6/2007 |
| WO | 2013030005 | A1 | 3/2013 |

* cited by examiner

APPARATUS FOR THE REMOVAL OF SLUDGE

BACKGROUND

The invention relates to the removal of sludge from underwater deposits.

Sludge can build up over time on the floors of artificial containers for water such as tanks or ponds or on the floors of natural bodies of water such as lakes and oceans. Removal of the sludge may be desirable to increase the volume or flow of water, to remove pollutants contained in the sludge, to collect the sludge for use as a resource or for other reasons.

The source of the sludge may be natural, e.g. from settlement of particles suspended in the water, or may be artificial, e.g. as a result of mining or drilling. It may comprise particles of a well-defined size or of a range of sizes. The size or range of sizes may vary substantially between different deposits. The sludge may contain varying proportions of water within its structure. As a result of the pattern of deposition, the sludge may be uniform or stratified. As a result of physical or chemical processes following deposition, the particles may be bonded together in a consolidated mass or they may be held together only by gravity. For the purposes of this specification, the term "sludge" should also be taken to include dense liquids and semi-solids such as wax that are not particulate in nature but have similar properties and, in particular, are susceptible to fluidization by the use of pressurized water.

One example of sludge that requires removal is an accumulation on the floors of the ponds in which nuclear waste is stored. The ponds are artificially constructed so the floors can be assumed to be flat and even but the presence of larger items dropped into the ponds cannot be ruled out. Because such sludge is radioactive, it requires efficient collection and careful disposal, and this must be achieved remotely from the presence of a human operator. Such sludge tends to have built up slowly over a long period and is therefore stratified and may be relatively strongly bonded. Previous attempts to remove sludge in this situation have achieved poor collection rates of less than 15%.

Another example of sludge that requires removal is an accumulation on the sea floor around oil or gas wells as a result of materials that have been spilled during the drilling and extraction processes. Sludge in this situation tends to be soft but poorly structured and it may form deep deposits. The natural sea floor on which the deposit rests may be uneven and its contours will likely be unknown.

SUMMARY OF THE INVENTION

The invention provides an apparatus for removing sludge from an underwater deposit as defined in claim 1.

The invention further provides a method of removing sludge from an underwater deposit as defined in claim 18.

Preferred but non-essential features of the invention are defined in the dependent claims.

The invention uses a blade to cut into the sludge first, followed by water jets acting against the surface of the blade to fluidize the sludge and convey it towards the rear of the collection chamber. Because the sludge is not fluidized until already inside the chamber, the fluidized sludge is effectively contained and very high collection rates can be achieved.

THE DRAWINGS

FIGS. 1 to 4 illustrate a first embodiment of the invention, which is an apparatus for removing stratified sludge from the flat floor of an artificial tank such as a nuclear waste storage pond. The apparatus comprises a housing 2, which defines a forward direction (indicated by an arrow 3) and an opposite rearward direction. In this embodiment the forward and rearward directions are horizontal, parallel to the floor of the pond (not shown).

Figure 1:
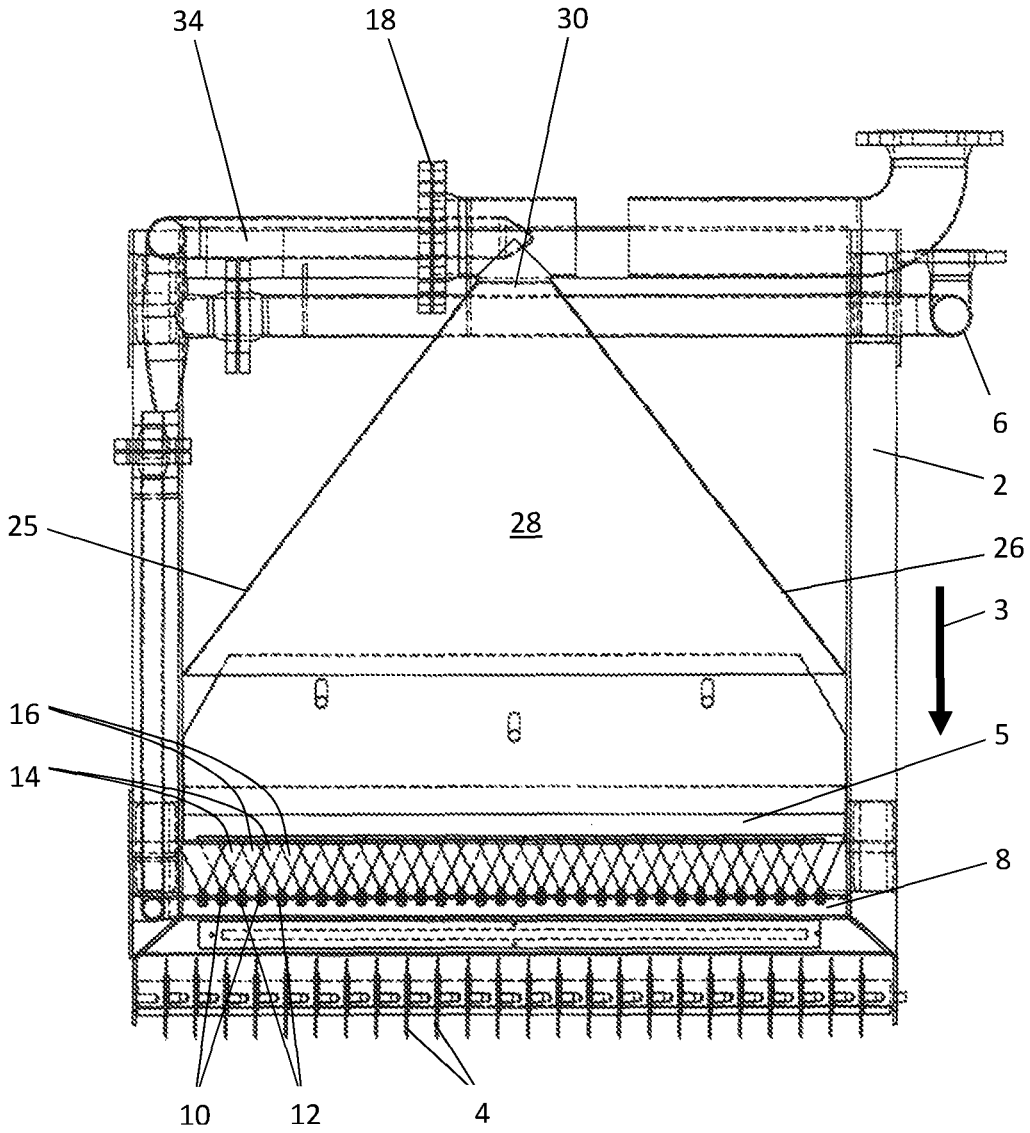
FIG. 1 is a plan view of an apparatus for removing sludge according to a first embodiment of the invention.
Figure 2:
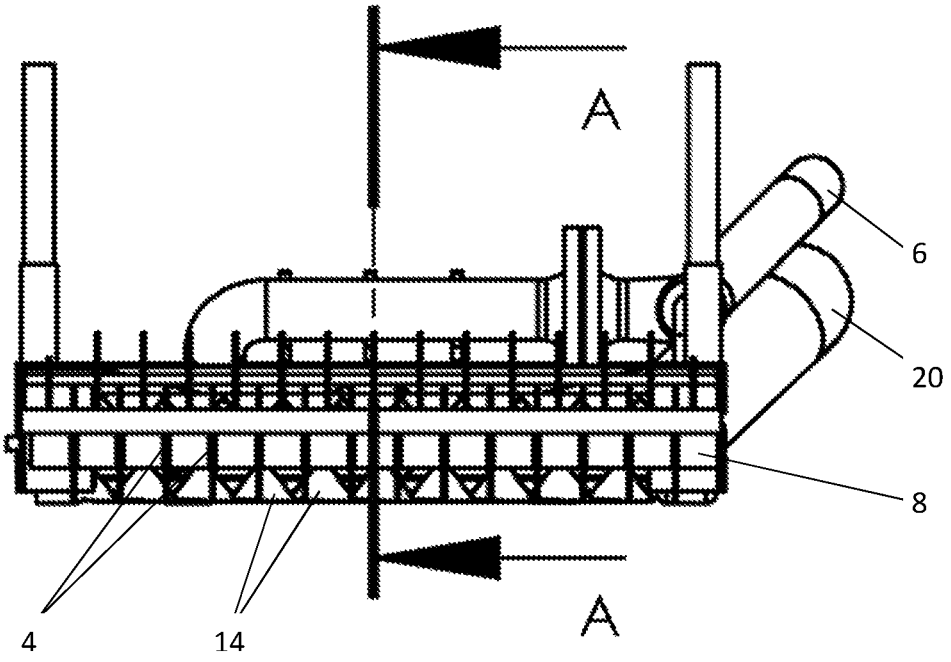
FIG. 2 is a front elevation of a variant of the apparatus of FIG. 1.
Figure 4:
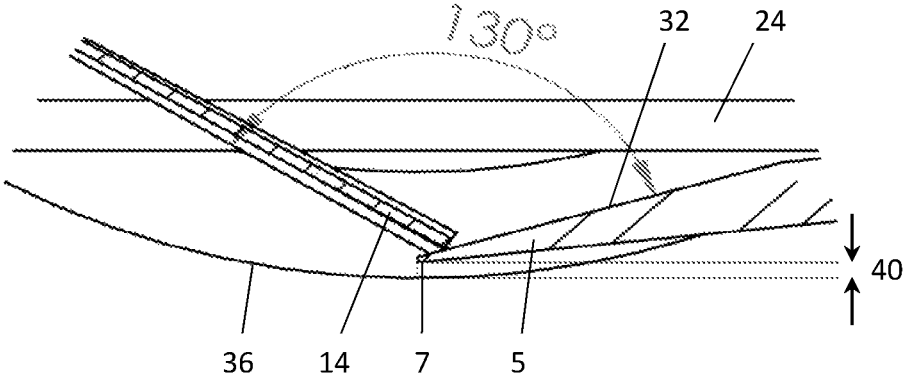
FIG. 4 is an enlargement of part of FIG. 3.
Figure 3:
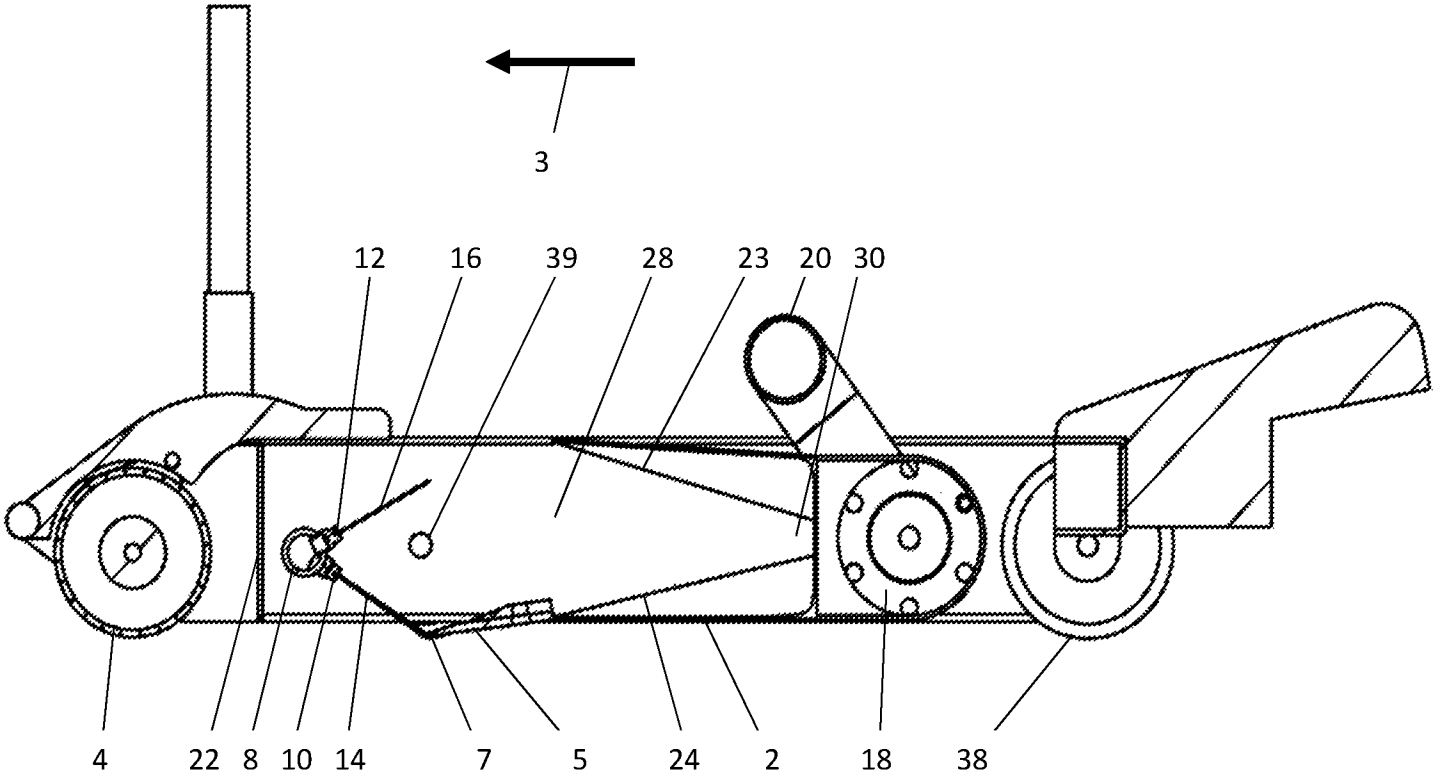
FIG. 3 is a longitudinal section on line A-A through the apparatus of FIG. 2.

FIG. 1 differs from FIGS. 2 to 4 in having a larger number of cutting discs 4 and jets 14,16. These differences do not affect the principle of operation of the apparatus and FIGS. 1 to 4 will be described as a single embodiment of the invention.

The operation of this embodiment of the apparatus will first be described in outline. As the apparatus moves forwards over the surface of the sludge, a transverse row of cutting discs 4 at the front of the apparatus slices vertically into the surface of the sludge. A transverse cutting blade 5 projects from the underside of the housing 2 so that, as the apparatus moves forwards, a cutting edge 7 of the blade 5 cuts horizontally into the surface of the sludge to separate a layer of sludge and direct it into the interior of the housing 2.

An inlet 6 delivers water at high pressure from an external source to a manifold 8 that extends transversely across the apparatus near to the cutting blade 5. A first set of nozzles 10 is arranged along the manifold to direct a first row of jets 14 of the pressurized water rearwards onto the surface of the blade 5. The first jets 14 fluidize the collected sludge and carry it towards the rear of the housing. A second set of nozzles 12 is arranged along the manifold to direct a second row of jets 16 of the pressurized water rearwards towards the roof of the housing 2. The second jets 16 assist with carrying the fluidized sludge towards the rear or the housing 2. A jet pump 18 removes water and the fluidized sludge from the rear end of the housing 2 and delivers it to an outlet 20 to be further processed externally of the apparatus.

The housing 2 provides structural support for all the other components. A front wall 22, top and bottom walls 23,24 and side walls 25,26 define a collection chamber 28. The collection chamber 28 tapers towards a port 30 at the rear of the housing 2. In the illustrated embodiment, both the top and bottom walls 23,24 and the left and right side walls 25,26 converge towards the port 30 but it is not essential that they should all do so. The housing will typically be formed from steel sheets but for particular applications the choice of material may be influenced by the properties of the sludge, for example its pH or its radioactivity.

The cutting blade 5 projects at a slight angle (e.g. 10°) from an opening in the bottom wall 24 of the housing 2. Preferably the cutting blade 5 is a separate component mounted on the housing, which permits it to be made of a different and wear-resistant material. It may be possible to replace the blade 5 when it has become worn. Alternatively, the blade 5 may be formed from a down-turned portion of the bottom housing wall 24. The cutting edge 7 of the blade 5 is preferably straight but an arcuate blade is also possible. The triangular gap between the blade 5 and the main plane of the lower housing wall 24 may be closed at each side by a triangular side wall (not shown) to prevent the escape of fluidized sludge before it enters the chamber 28.

The row of cutting discs 4 is arranged along a transverse, horizontal axis at the front of the housing 2 so that each disc 4 is in a generally vertical plane. The discs 4 may be mounted on a common axle or each disc 4 may be mounted so that it can rotate independently. The cutting discs 4 may be driven to rotate by turning the axle or they may rotate passively in response to the forward movement of the apparatus over the surface of the sludge. The cutting discs 4 comprise blades around their periphery, which may be continuous or segmented into teeth. The effect of the cutting discs 4 is to slice the top layer of sludge into longitudinal strips before it is lifted by the horizontal cutting blade 5 of the apparatus. The lower rim of the cutting discs 4 should therefore project at least as far as the cutting blade 5 below the plane of the bottom wall 24 of the housing 2. The spacing between the discs 4 partly determines the size of the lumps of sludge that are lifted by the blade 5 and fluidized by the jets 14. The spacing may therefore need to be smaller in the case of tougher, more consolidated sludge deposits.

A grid (not shown) of suitable spacing may be provided to prevent objects greater than a certain size from entering the collection chamber 28 through the opening above the blade 5, including solid objects that might have been dropped into the pond and be resistant to cutting by the discs 4.

The manifold 8 extends across the width of the housing, following the line of the blade 5. The first set of nozzles 10 is arranged along the manifold 8 to direct jets 14 of pressurized water from the manifold through the collection chamber 28 to impinge on the surface 32 of the blade 5 that faces into the interior of the housing 2. Each nozzle 10 is in the form of a slit so that the jet is fan-shaped, having a cross-section of much greater extent in a direction parallel to the cutting edge 7 of the blade 5 than its extent in the perpendicular direction. The divergence of the fan-shaped jet 14 from the nozzle 10 is typically more than 30° but it may be smaller if adjacent nozzles are closer together. The jets 14 should meet the surface 32 of the cutting blade 5 in a continuous line with no gaps between them. As seen in FIG. 4, the line of jets 14 preferably hits the surface 32 of the blade 5 close to its tip, for example within 10 mm of the edge 7.

The jets 14 hit the blade surface 32 at an incident angle that imparts a rearward component of motion relative to the surface. The incident angle may be chosen to suit the nature of the sludge that is to be fluidized and carried away by the jets. For strongly bonded sludge, a steeper incident angle, approaching perpendicular to the surface 32, may be desirable to promote good fluidization. For unconsolidated sludge, the emphasis may be on sweeping the sludge towards the rear of the chamber 28 so a shallower incident angle may be more efficient. In FIG. 4, the angle is 130°, falling in the typical range of 115° to 135°. Any angle less than 95° is unlikely to have sufficient momentum to carry the fluidized sludge to the rear of the chamber and any angle greater than 175° is unlikely to provide sufficient impact against the surface 32. Note that these incident angles are measured between the centre line of the jet 14 and the surface 32 of the blade, using the convention that an angle of 0° represents a jet parallel to the blade surface directed towards the front of the apparatus and 180° represents a jet parallel to the blade surface directed towards the rear of the apparatus.

The choice of pressure at which the water is delivered to the nozzles 10 is determined primarily by the consolidation of the sludge, as well as by the configuration of the nozzles 10 and the length of water through which the jet 14 has to pass from the nozzle to the blade surface 32. For unconsolidated sludge, a pressure of 5 bar (0.5 MPa) may be sufficient, while for strongly consolidated sludge a pressure in excess of 1000 bar (100 MPa) may be required. The pressure can be adjusted during use to adapt to the conditions discovered, subject to the rating of the nozzles 10.

For certain types of sludge (e.g. wax) the pressurized water may be heated to assist with the fluidization process. Similarly, the water may contain additives or a fluid such as a solvent may be used in place of water.

A second set of nozzles 12 is arranged along the manifold 8 to direct jets 16 of pressurized water from the manifold through the collection chamber 28 towards the top wall 23 of the housing 2. Again, it is preferred that the nozzles 12 should form fan-shaped jets 16 that merge into a continuous line. However, it is not essential that the jets 16 should impinge on the top wall 23 because no significant fluidization of sludge occurs at this location. The second nozzles 12 need not be of the same design as the first nozzles 10. The second nozzles 12 could be provided along a second manifold (not shown) which would allow their position or the pressure of the water supply to them to be independently chosen. More conveniently, the first and second nozzles may be arranged alternately along the manifold 8, as shown in FIG. 2. The second jets 16 have a rearward component of motion relative to the top wall 23, whereby the first and second jets together create a flow of water and fluidized sludge towards the port 30 at the rear of the collection chamber 28. The two rows of fan-shaped jets 14,16 effectively prevent any fluidized sludge from escaping to the front of the housing or through the opening in the bottom wall 24 of the housing 2.

The pump 18 is connected between the port 30 and the outlet 8 to remove water and fluidized sludge from the collection chamber 28. The pump 18 in FIG. 1 is a jet pump, driven by pressurized water from the inlet 6 that is delivered through a branch 34. Other types of pump such as centrifugal pump or a macerating pump may alternatively be used. The rate of flow of the pump should be adjustable to accommodate the variable flow of the jets 14,16. The size of the port 30 and the capacity of the pump should be chosen to accommodate the largest lumps that are capable of entering the collection chamber 28 and surviving the fluidization process.

The apparatus normally rests with the bottom wall 24 of the housing 2 on the surface of the sludge deposit. A remotely operated tractor unit (not shown) drives the apparatus forwards over the surface so that the top layer of sludge is scraped up by the blade 5, fluidized and collected in the chamber 28. The tractor unit may push or pull the apparatus; pushing is preferred because it helps to embed the blade 5 in the sludge. It has been found effective for the tractor to drive the apparatus in a reciprocating motion, repeatedly pushing it forwards by a few centimeters then back by a shorter distance.

When the sludge deposit has been almost completely removed, it is important that the cutting edge 7 of the blade 5 should not ground on the floor of the pond. The apparatus is therefore provided with front and rear support wheels 36,38 that can run along the floor. The front wheels 36 are not shown in FIG. 3 but they rotate about the axle 39. The height of the axle 39 may be adjustable to ensure the correct offset 40 between the tip of the blade 5 and the floor.

Figure 5:
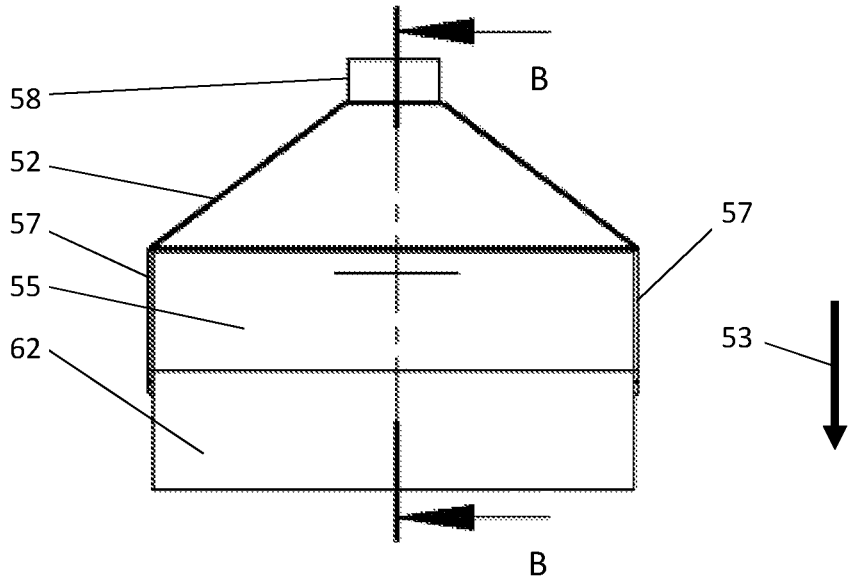
FIG. 5 is a side elevation of an apparatus for removing sludge according to a second embodiment of the invention.
Figure 6:
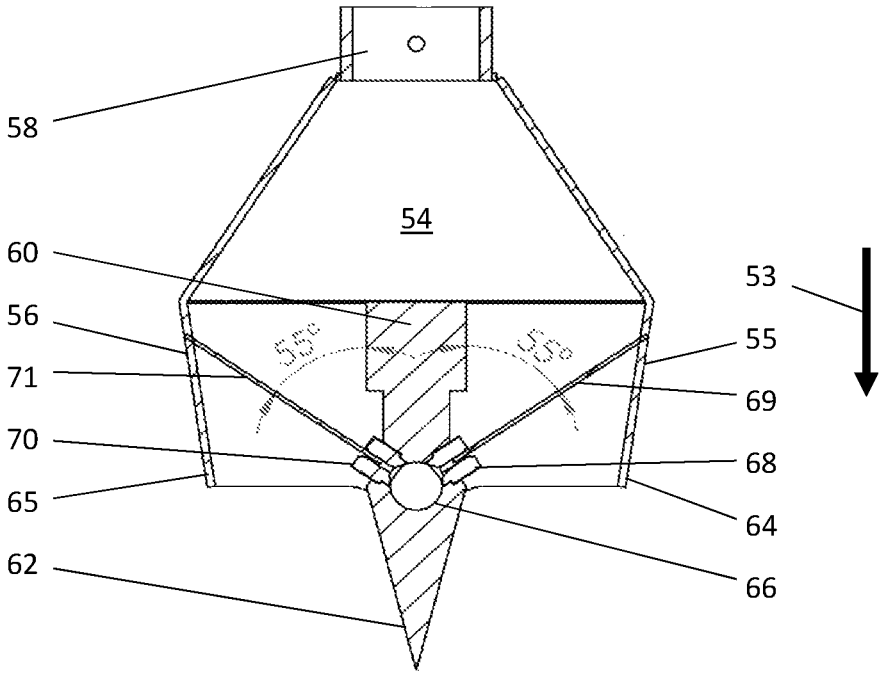
FIG. 6 is a cross section on line B-B of the apparatus of FIG. 5.

FIGS. 5 and 6 illustrate a second embodiment of the invention, which is an apparatus for removing a sludge from deep deposit that may not be stratified and may not lie on a level floor. This apparatus is particularly suitable for use with soft, unconsolidated sludge.

The apparatus comprises a housing 52, which defines a forward direction (indicated by an arrow 53) and an opposite rearward direction. In this embodiment the forward and rearward directions are typically vertical, the apparatus being lowered from a crane under its own weight or actively pushed down into the bulk sludge deposit, but if the apparatus is pushed it may in fact be used in any orientation. As with the first embodiment, reciprocal movements may be applied to the apparatus or vibration at up to ultrasonic frequencies may be used to assist the passage of the blades through the sludge.

The housing 52 comprises a collection chamber 54 surrounded by side walls 55,56 and end walls 57 but generally open in the forward direction. The collection chamber 54 tapers towards a port 58 at the rear end, from which water and fluidized sludge can be removed by a pump (not shown) for further processing externally to the apparatus. A grid (not shown) of suitable spacing may be provided to prevent objects greater than a certain size from entering the collection chamber 54 through the opening.

A central boss 60 extends across the collection chamber 54 between the end walls 57. A blade 62 projects forwards from the boss 60 through the opening of the collection chamber 54. The blade 62 may be integral with the boss 60 or it may be a separate component mounted on the boss 60, which can optionally be replaced when it has become worn.

As the apparatus moves forwards, the forward blade 62 slices into the bulk sludge, deflecting it to each side of the blade 62 and into the opening of the collection chamber 54. The front edges of the side walls 55,56 serve as cutting blades 64,65 that also penetrate the sludge and guide parts of it into the chamber 54. If the sludge is sufficiently soft, the cutting blades 64,65 need not be particularly sharp. As shown in FIG. 6, it is preferred that the cutting blades 64,65 should converge slightly in the forward direction to promote a good seal against the undisturbed sludge. This helps to prevent the escape of fluidized sludge that is circulating in the collection chamber 54.

An inlet (not shown) delivers water at high pressure from an external source to a manifold 66 that extends along the central boss 60. A first set of nozzles 68 is arranged along one side of the manifold 66 to direct a first row of jets 69 of the pressurized water onto the surface of one cutting blade 64 (i.e. the side wall 55). A second set of nozzles 70 is arranged along the other side of the manifold 66 to direct a second row of jets 71 of the pressurized water onto the surface of the opposite cutting blade 65 (i.e. the other side wall 56). The apparatus is therefore mirror-symmetrical about its centre line, although it is possible for the symmetry to be slightly broken by alternating the first and second nozzles 68,70 along the length of the manifold 8.

As in the first embodiment, the jets 69,71 preferably fan out from the nozzles 68,70 to form an unbroken line where they impinge on the side walls 55,56. Again, as in the first embodiment, the angle of incidence of the jets 69,71 on the side walls 55,56 may vary substantially, provided that it has a component of motion in the rearward direction relative to the surface of the side walls in order that the jets rebounding from the side walls should convey the fluidized sludge towards the rear of the collection chamber 54.

The invention claimed is:

1. Apparatus for removing sludge from an underwater deposit, comprising:

a housing having a front and a rear and defining an interior;

an outlet through which sludge can be removed from the rear of the housing;

a first blade on the housing, the first blade having a cutting edge that points forwards and a first blade surface to the rear of the cutting edge that faces the interior of the housing;

at least one first nozzle positioned and oriented to direct a jet of water onto the first blade surface, the jet having a component of motion in the rearward direction relative to the blade surface;

a second blade on an opposite side of the housing from the first blade, the second blade having a cutting edge that points forwards and a second blade surface to the rear of the cutting edge that faces the first blade surface across the interior of the housing; and at least one second nozzle positioned and oriented to direct a jet of water onto the second blade surface, the jet having a component of motion in the rearward direction relative to the second blade surface.

2. Apparatus according to claim 1, wherein the angle of incidence of the jet (14,69) on strikes the first blade surface at an angle of incidence of in the range 115° to 135°.

3. Apparatus according to claim 1, wherein an extent of a cross-section of the jet of water in a direction parallel to the cutting edge is greater than an extent of the cross-section of the jet of water in a direction perpendicular to the cutting edge.

4. Apparatus according to claim 3, wherein the jet of water diverges from the first nozzle by an angle of more than 30° in the direction parallel to the cutting edge.

5. Apparatus according to claim 1, wherein the first blade extends across a width of the housing, the apparatus comprising a row of the first nozzles positioned and oriented to direct respective jets of water onto the first blade surface at intervals across its width.

6. Apparatus according to claim 1, which is substantially mirror-symmetrical about a plane halfway between the first and second blades.

7. Apparatus according to claim 6, wherein the first and second nozzles are mounted on a central boss, which contains a manifold of a pressurized water supply.

8. Apparatus according to claim 7, wherein the central boss comprises a sharp edge pointing forwards.

9. Apparatus according to claim 1, further comprising a jet pump connected between the rear of the housing and the outlet.

10. Apparatus according to claim 9, wherein the jet pump and the nozzles receive pressurized water from a common supply.

11. Apparatus according to claim 1, further comprising a tractor unit to the rear of the first blade for pushing the housing forwards.

12. A method of removing sludge from an underwater deposit, comprising:

pushing a housing in a forward direction such that cutting edges of respective first and second blades on opposite sides of the housing cut into the sludge;

directing at least one first jet of water rearwards onto a surface of the first blade that lies to the rear of the cutting edge of the first blade, and directing at least one second jet of water rearwards towards a surface of the second blade that lies to the rear of the cutting edge of the second blade, wherein the second blade surface faces the first blade surface across an interior of the housing whereby the first and second jets of water carry the cut sludge towards the rear of the housing and removing sludge from the rear of the housing.

13. The method of claim 12, further comprising intermittently retracting the housing in the rearward direction and repeating the step of pushing the housing in the forward direction.

14. The method of claim 12, wherein the forward direction is substantially vertical.

15. Apparatus for removing sludge from an underwater deposit, a housing having a front and a rear and defining an interior;

an outlet through which sludge can be removed from the rear of the housing;

a first blade on the housing, the first blade having a cutting edge that points forwards and a first blade surface to the rear of the cutting edge that faces the interior of the housing; and at least one first nozzle positioned and oriented to direct a jet of water onto the first blade surface, the jet having a component of motion in the rearward direction relative to the blade surface;

wherein an extent of a cross-section of the jet of water in a direction parallel to the cutting edge is greater than an extent of the cross-section of the jet of a water in a direction perpendicular to the cutting edge.

16. Apparatus according to claim 15, wherein the jet of water diverges from the first nozzle by an angle of more than 30° in the direction parallel to the cutting edge.

17. Apparatus according to claim 15, wherein the first blade extends across a width of the housing, the apparatus comprising a row of the first nozzles positioned and oriented to direct respective jets of water onto the first blade surface at intervals across its width.

18. Apparatus according to claim 15, wherein the jet strikes the first blade surface at an angle of incidence in the range 115° to 135°.

19. Apparatus according to claim 15, comprising:

a housing wall on an opposite side of the housing from the first blade, the housing wall having a wall surface that faces the interior of the housing; and at least one second nozzle positioned and oriented to direct a jet of water towards the wall surface, the jet having a component of motion in the rearward direction relative to the wall surface.

20. Apparatus according to claim 19, wherein the cutting edge of the first blade protrudes from the housing.

21. Apparatus according to claim 20, further comprising a support wheel mounted on the housing, wherein a rim of the support wheel protrudes from the housing further than the cutting edge.

22. Apparatus according to claim 19, further comprising at least one cutting disc forward of the cutting edge.

23. Apparatus according to claim 22, comprising a row of the cutting discs spaced along an axis transverse to the forward direction.

24. A method of removing sludge front an underwater deposit, comprising:

pushing a housing in a forward direction such that a cutting edge of a first blade on the housing cuts into the sludge;

directing at least one first jet of water rearwards onto a surface of the first blade that lies to the rear of the cutting edge of the first blade, whereby the jet of water carries the cut sludge towards the rear of the housing; and removing sludge from the rear of the housing;

wherein an extent of a cross-section of the first jet of water in a direction parallel to the cutting edge is greater than an extent of the cross-section of the jet of water in a direction perpendicular to the cutting edge.

25. The method of claim 24, further comprising intermittently retracting the housing in the rearward direction and repeating the step of pushing the housing in the forward direction.

26. The method of claim 24, further comprising directing at least one second jet of water rearwards onto a wall surface on an opposite side of the housing from the first blade.

27. The method of claim 24, wherein the forward direction is substantially horizontal, whereby the housing is pushed over a surface of the sludge and the first blade protrudes from the housing to cut into the sludge.

28. The method of claim 24, further comprising using cutting wheels to cut into the surface of the sludge ahead of the first blade.

29. The method of claim 24, wherein the sludge rests on a substrate, the method further comprising rolling the housing on support wheels that rest on the substrate to hold the first blade clear of the substrate.

30. Apparatus according to claim 1, wherein the first and second blade surfaces are substantially flat.

31. The method of claim 12, wherein the first and second blade surfaces are substantially flat.

* * * * *